US011305149B2

(12) United States Patent
Smith

(10) Patent No.: US 11,305,149 B2
(45) Date of Patent: Apr. 19, 2022

(54) SPRING-LOADED ADJUSTABLE WORKOUT HANDLE APPARATUS

(71) Applicant: Percell Smith, Springfield Gardens, NY (US)

(72) Inventor: Percell Smith, Springfield Gardens, NY (US)

( * ) Notice: Subject to any disclaimer, the term of this patent is extended or adjusted under 35 U.S.C. 154(b) by 70 days.

(21) Appl. No.: 16/986,839

(22) Filed: Aug. 6, 2020

(65) Prior Publication Data

US 2022/0040523 A1 Feb. 10, 2022

(51) Int. Cl.

| | |
|---|---|
| ***A63B 21/00*** | (2006.01) |
| ***A63B 21/02*** | (2006.01) |
| ***A63B 23/12*** | (2006.01) |
| ***A63B 21/04*** | (2006.01) |

(52) U.S. Cl.

CPC ..... *A63B 21/4035* (2015.10); *A63B 21/023* (2013.01); *A63B 21/0428* (2013.01); *A63B 23/1236* (2013.01); *A63B 2225/093* (2013.01)

(58) Field of Classification Search

CPC ..... A63B 21/023; A63B 21/0428; A63B 21/4035; A63B 23/1236; A63B 2225/093

See application file for complete search history.

(56) References Cited

U.S. PATENT DOCUMENTS 5,582,565 A * 12/1996 Soria ..... A63B 21/00047 482/141
6,129,651 A * 10/2000 Denaro ..... A63B 21/00047 482/141
7,637,851 B1 * 12/2009 Lormil ..... A63B 23/12 482/141
8,702,574 B2 * 4/2014 Abranchess ..... A63B 23/0355 482/141
8,864,638 B2 * 10/2014 Ross ..... A63B 23/1218 482/141
9,248,334 B2 * 2/2016 Dupuis ..... A63B 21/15
9,358,419 B1 * 6/2016 Smith ..... A63B 23/1209
9,717,948 B1 * 8/2017 Hsu ..... F16B 7/00
2006/0040809 A1 * 2/2006 Godbold ..... A63B 23/12 482/141
2012/0040811 A1 * 2/2012 DeTore ..... A63B 21/00047 482/141
2013/0072365 A1 * 3/2013 Ross ..... A63B 23/1236 482/141
2013/0123082 A1 * 5/2013 Bashraheel ..... A63B 21/4019 482/141
2014/0329651 A1 * 11/2014 Thomason ..... A63B 21/4035 482/141

(Continued)

*Primary Examiner* — Joshua Lee

(57) ABSTRACT

A spring-loaded adjustable workout handle apparatus for adjustable height and cushioned workouts includes a handle having a parallel portion and a pair of perpendicular return portions. A pair of support tubes is coupled to the perpendicular return portions. Each support tube is cylindrical and has a sidewall and an open bottom end. A pair of support legs is coupled to the pair of support tubes. Each support leg has a shaft portion and a foot portion. The shaft portion is slidably engaged within the open bottom end. Each of a pair of springs is coupled within one of the support tubes and is compressible by the shaft portion of the respective support leg. Each of a pair of adjustment mechanisms is selectively engageable with the pair of support tubes and the pair of support legs to adjust a fixed height of the handle.

7 Claims, 5 Drawing Sheets

(56) References Cited

U.S. PATENT DOCUMENTS

| | | | | |
|---|---|---|---|---|
| 2015/0246261 | A1* | 9/2015 | Chen | A63B 21/068<br>482/141 |
| 2015/0352397 | A1* | 12/2015 | Essapen | A63B 23/03508<br>482/128 |
| 2019/0143168 | A1* | 5/2019 | Chang | A63B 23/0211<br>482/138 |
| 2021/0178216 | A1* | 6/2021 | Ducato | A63B 21/4035 |

* cited by examiner

SPRING-LOADED ADJUSTABLE WORKOUT HANDLE APPARATUS

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to workout handle devices and more particularly pertains to a new workout handle device for adjustable height and cushioned workouts.

(2) Description of Related Art Including Information Disclosed Under 37 CFR 1.97 and 1.98

The prior art relates to workout handle devices. Existing devices may offer parallel grips for pushups. Most existing devices are not adjustable. Known devices are also fixed and do not incorporate a spring-loaded mechanism that allows for cushioned movements.

(h) BRIEF SUMMARY OF THE INVENTION

An embodiment of the disclosure meets the needs presented above by generally comprising a handle having a parallel portion and a pair of perpendicular return portions. A pair of support tubes is coupled to the handle. The pair of support tubes is coupled to the perpendicular return portions. Each support tube is cylindrical and has a sidewall and an open bottom end. A pair of support legs is coupled to the pair of support tubes. Each support leg has a shaft portion and a foot portion. The shaft portion is slidably engaged within the open bottom end. A pair of springs is coupled to the pair of support tubes. Each spring is coupled within one of the support tubes and is compressible by the shaft portion of the respective support leg. Each of a pair of adjustment mechanisms is selectively engageable with the pair of support tubes and the pair of support legs to adjust a fixed height of the handle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
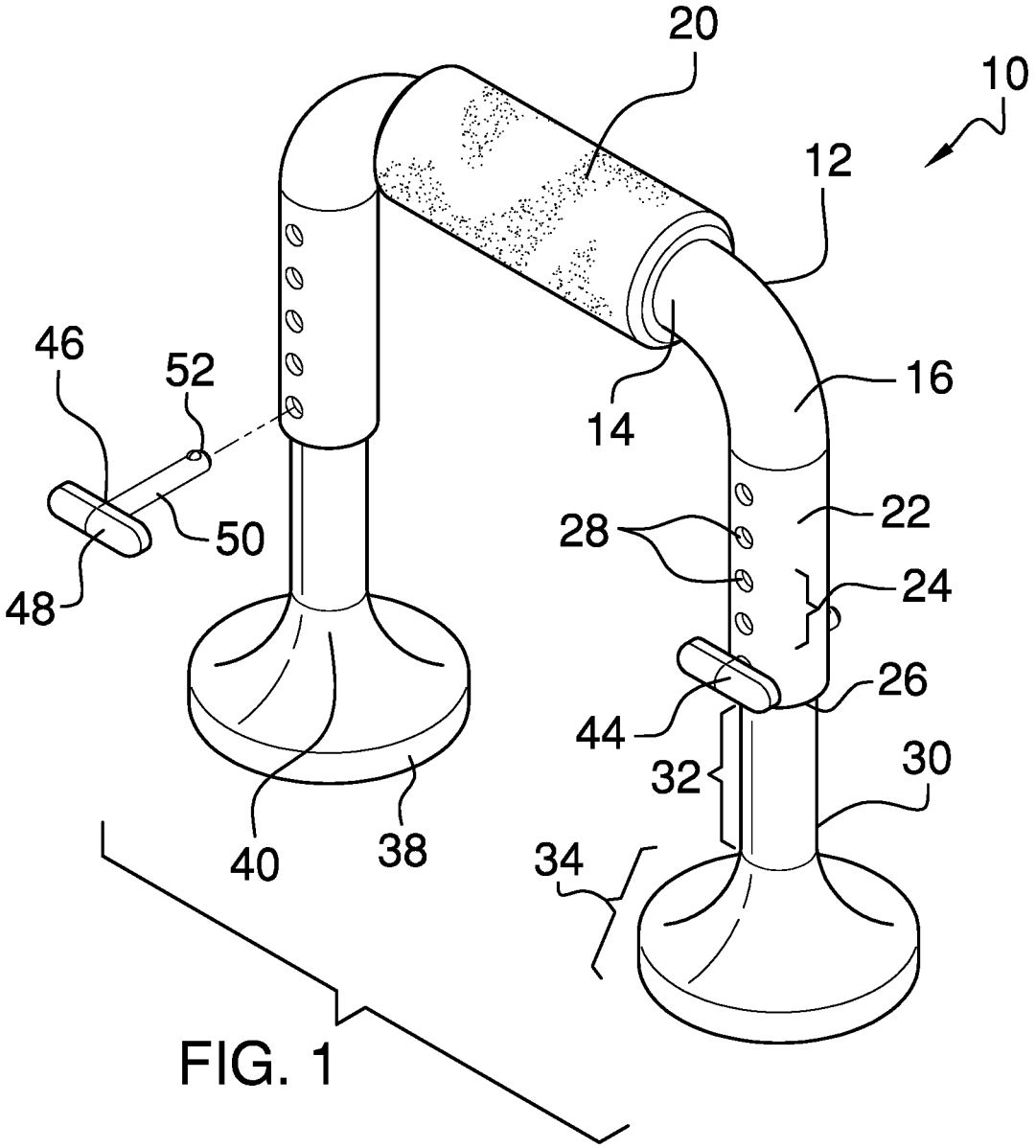
FIG. 1 is an isometric view of a spring-loaded adjustable workout handle apparatus according to an embodiment of the disclosure.
Figure 2:
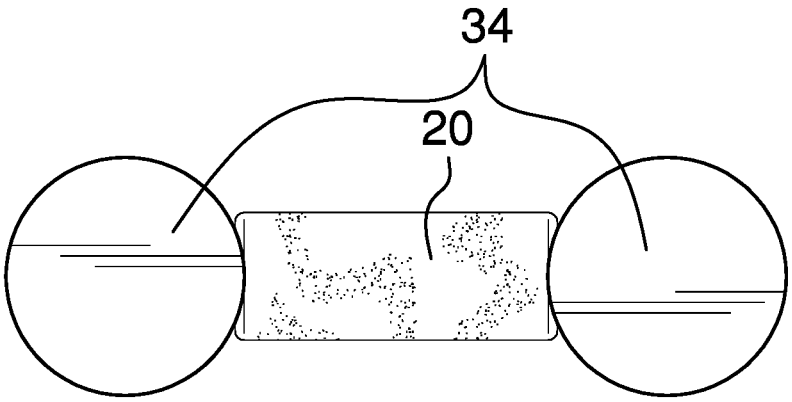
FIG. 2 is a bottom plan view of an embodiment of the disclosure.
Figure 3:
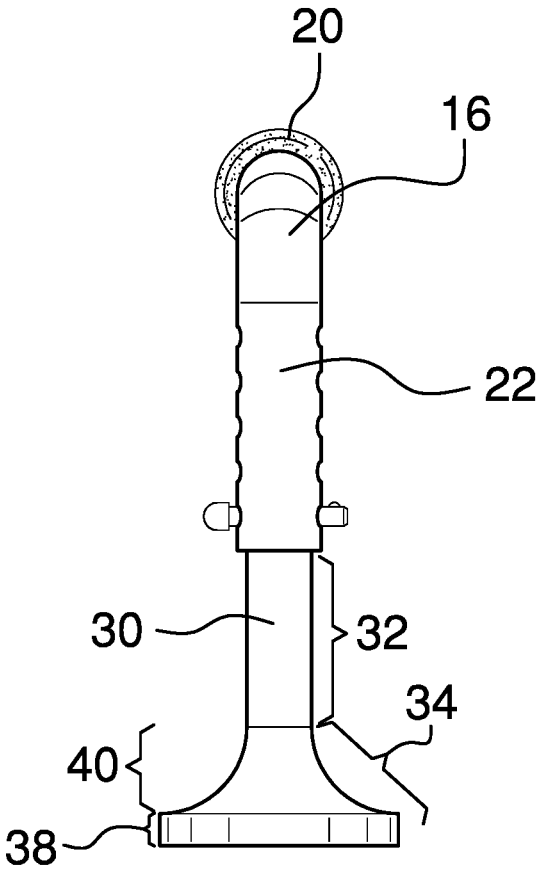
FIG. 3 is a side elevation view of an embodiment of the disclosure.
Figure 4:
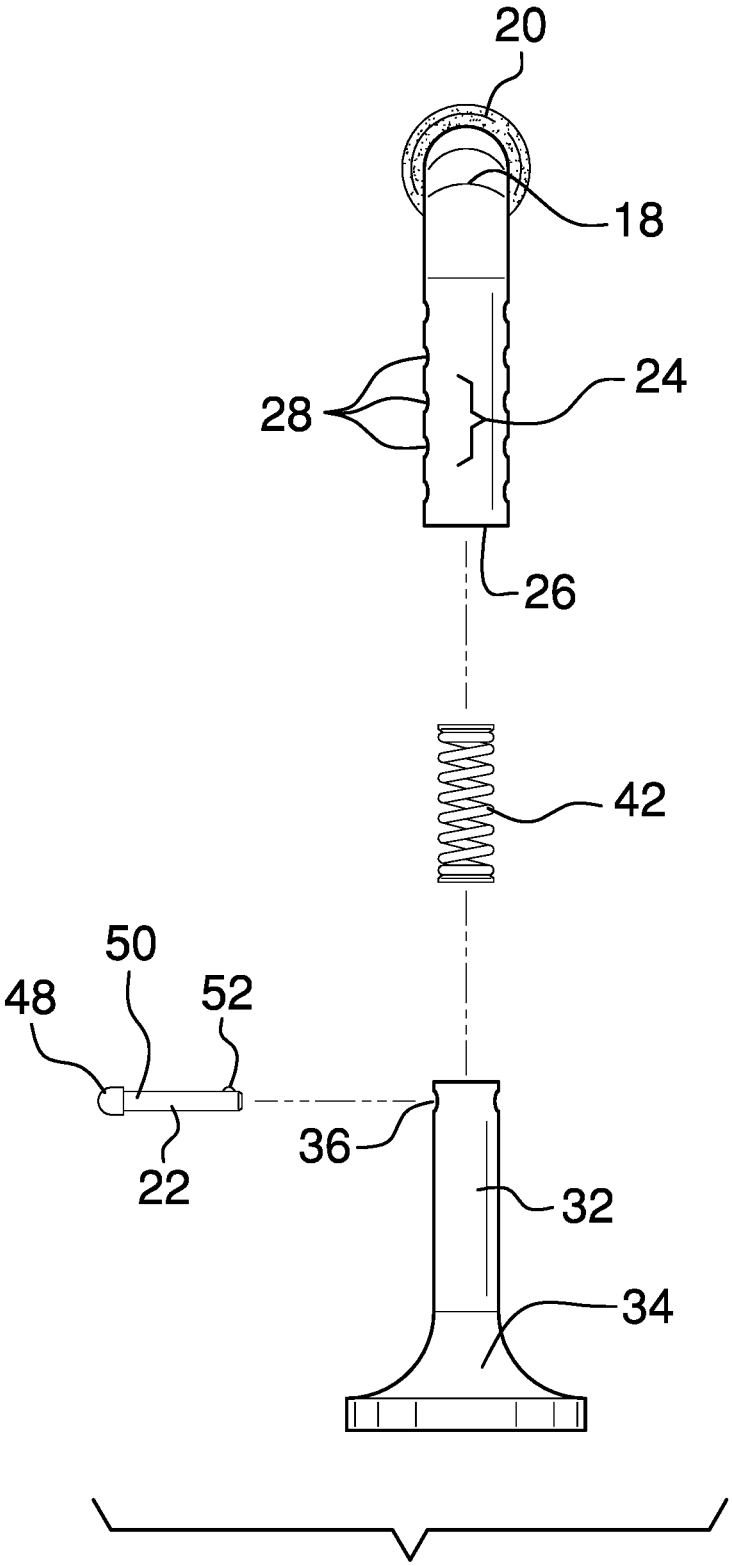
FIG. 4 is an exploded view of an embodiment of the disclosure.
Figure 5:
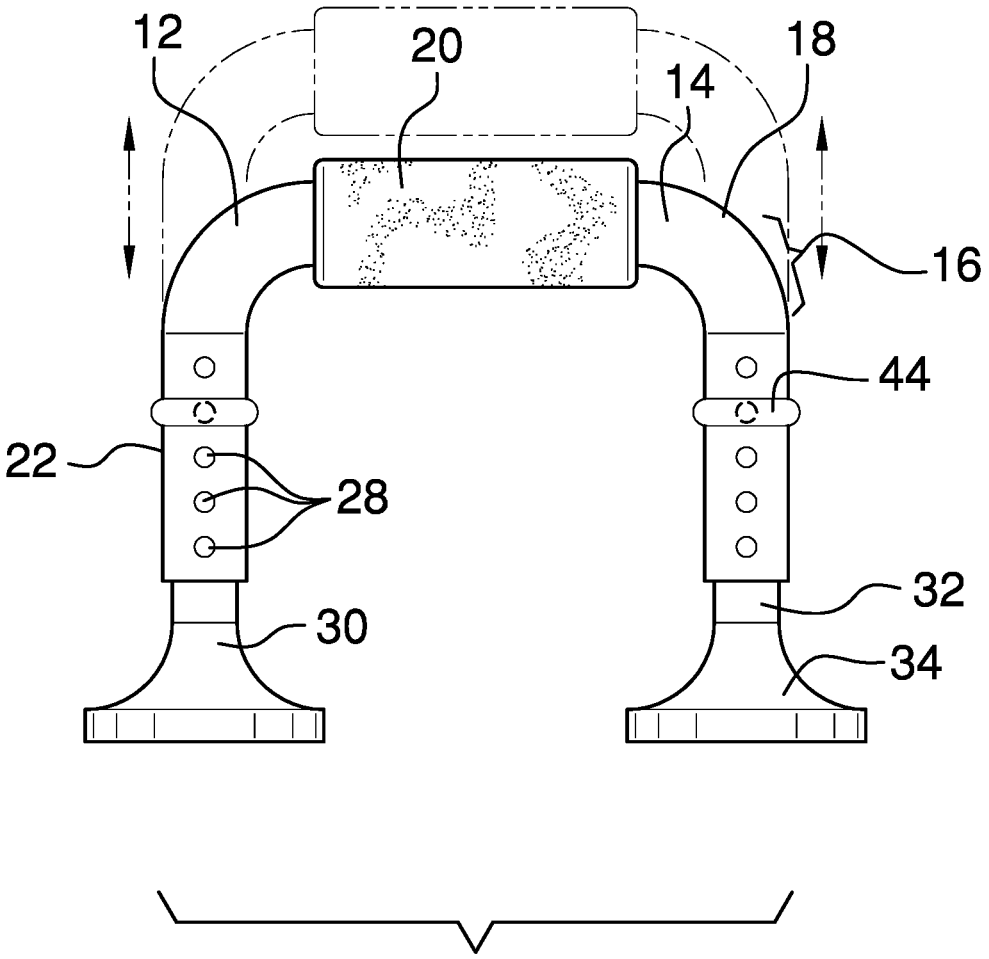
FIG. 5 is a front elevation view of an embodiment of the disclosure.
Figure 6:
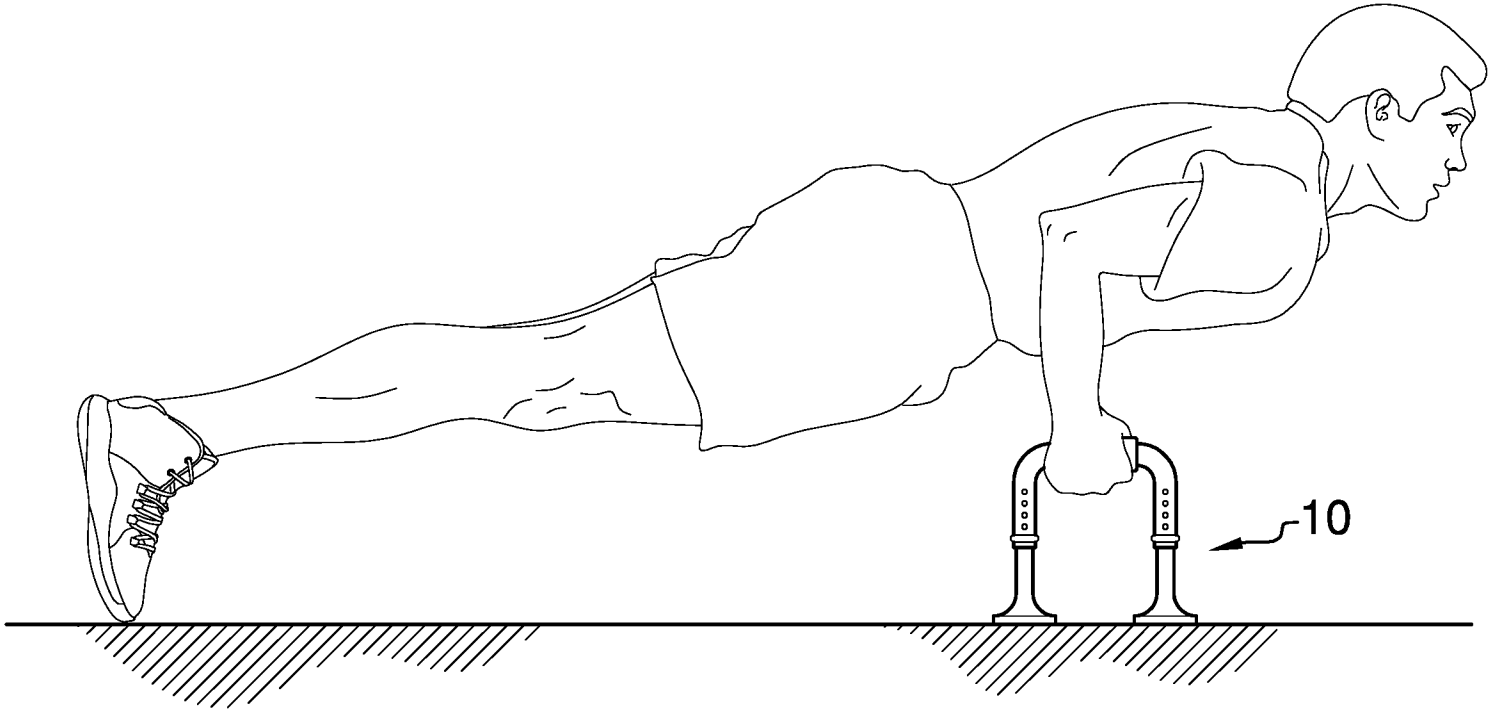
FIG. 6 is an in-use view of an embodiment of the disclosure.

With reference now to the drawings, and in particular to FIGS. 1 through 6 thereof, a new workout handle device embodying the principles and concepts of an embodiment of the disclosure and generally designated by the reference numeral 10 will be described.

As best illustrated in FIGS. 1 through 6, the spring-loaded adjustable workout handle apparatus 10 generally comprises a handle 12 having a parallel portion 14 and a pair of perpendicular return portions 16. The parallel portion 14 is dimensioned to be comfortably gripped by an adult hand. Each return portion 16 may include a rounded 90° elbow. A pad 20 may be coupled to the handle 12. The pad 20 is tubular and coupled around the parallel portion 14 of the handle. The handle 12 may be tubular or cylindrical.

A pair of support tubes 22 is coupled to the handle 12. The pair of support tubes 22 is coupled to the perpendicular return portions 16. Each support tube 22 is cylindrical and has a sidewall 24 and an open bottom end 26. Each support tube 22 may have a plurality of first adjustment apertures 28 extending through the sidewall 24. The first adjustment apertures 28 may be arranged in a pair of vertical arrays 180° apart.

A pair of support legs 30 is coupled to the pair of support tubes 22. Each support leg 30 has a shaft portion 32 and a foot portion 34 with the shaft portion 32 slidably engaged within the open bottom end 26. The shaft portion 32 of each support leg may have a second adjustment aperture 36 extending therethrough. Each foot portion 34 may have a circular base portion 38 and a filleted support portion 40 extending to the shaft portion 32. The support legs 30 may thus have a larger contact area with the ground for stability as well as a reinforced structure with only smooth edges for user comfort and accident prevention.

A pair of springs 42 is coupled to the pair of support tubes 22. Each spring 42 is coupled within one of the support tubes 22 and is compressible by the shaft portion 32 of the respective support leg 30. Each of a pair of adjustment mechanisms 44 is selectively engageable with the pair of support tubes 22 and the pair of support legs 30 to adjust a fixed height of the handle 12. Each adjustment mechanism 44 may be a peg 46 having a head portion 48, an engagement portion 50, and a catch 52. The head portion 48 of each peg is perpendicular to the engagement portion 50 and provides a place for the user to grip the peg 46 and slide the engagement portion through opposing apertures of the first adjustment apertures 28 and the second adjustment aperture 36. The catch 52 may be a spring-loaded ball or other selectively depressible protrusion to prevent the peg 46 from accidentally disengaging the support tube 22.

In use, the handle 12 is depressed to a chosen height and the adjustment mechanisms 44 are engaged to fix the height. The apparatus 10 may then be used like a traditional hand grip for pushups or other exercises. The apparatus 10 may alternatively be used without engaging the pair of adjustment mechanisms 44 to allow for the pair of springs 42 to act as dampeners or shock absorbers while doing exercises such as plyometric movements to protect the user's joints.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A spring-loaded adjustable workout handle apparatus comprising:

a handle having a parallel portion and a pair of perpendicular return portions;

a pair of support tubes coupled to the handle, the pair of support tubes being coupled to the perpendicular return portions, each support tube being cylindrical and having a sidewall and an open bottom end;

a pair of support legs coupled to the pair of support tubes, each support leg having a shaft portion and a foot portion, the shaft portion being slidably engaged within the open bottom end;

a pair of springs coupled to the pair of support tubes, each spring being coupled within one of the support tubes and compressible by the shaft portion of the respective support leg; and a pair of adjustment mechanisms, each adjustment mechanism being selectively engageable with the pair of support tubes and the pair of support legs to adjust a fixed height of the handle.

2. The spring-loaded adjustable workout handle apparatus of claim 1 further comprising a pad coupled to the handle, the pad being tubular and coupled around the parallel portion of the handle.

3. The spring-loaded adjustable workout handle apparatus of claim 1 further comprising each support tube having a plurality of first adjustment apertures extending through the sidewall, the shaft portion of each support leg having a second adjustment aperture extending therethrough; each adjustment mechanism being a peg having a head portion, an engagement portion, and a catch.

4. The spring-loaded adjustable workout handle apparatus of claim 3 further comprising the head portion of each peg being perpendicular to the engagement portion.

5. The spring-loaded adjustable workout handle apparatus of claim 1 further comprising each return portion being a rounded 90° elbow.

6. The spring-loaded adjustable workout handle apparatus of claim 1 further comprising each foot portion having a circular base portion and a filleted support portion extending to the shaft portion.

7. A spring-loaded adjustable workout handle apparatus comprising:

a handle having a parallel portion and a pair of perpendicular return portions, each return portion being a rounded 90° elbow;

a pad coupled to the handle, the pad being tubular and coupled around the parallel portion of the handle;

a pair of support tubes coupled to the handle, the pair of support tubes being coupled to the perpendicular return portions, each support tube being cylindrical and having a sidewall and an open bottom end, each support tube having a plurality of first adjustment apertures extending through the sidewall;

a pair of support legs coupled to the pair of support tubes, each support leg having a shaft portion and a foot portion, the shaft portion being slidably engaged within the open bottom end, the shaft portion of each support leg having a second adjustment aperture extending therethrough, each foot portion having a circular base portion and a filleted support portion extending to the shaft portion;

a pair of springs coupled to the pair of support tubes, each spring being coupled within one of the support tubes and compressible by the shaft portion of the respective support leg; and a pair of adjustment mechanisms, each adjustment mechanism being selectively engageable with the pair of support tubes and the pair of support legs to adjust a fixed height of the handle, each adjustment mechanism being a peg having a head portion, an engagement portion, and a catch, the head portion of each peg being perpendicular to the engagement portion.

* * * * *